US005289611A

United States Patent [19]

Yonkers et al.

[11] Patent Number: 5,289,611

[45] Date of Patent: Mar. 1, 1994

[54] EXTRACTOR WITH MANUAL PRIMING PUMP

[75] Inventors: Robert A. Yonkers, Grandville; Richard L. Norwood, Rockford, both of Mich.

[73] Assignee: Bissell Inc., Grand Rapids, Mich.

[21] Appl. No.: 753,741

[22] Filed: Sep. 3, 1991

[51] Int. Cl.[5] ..... A47L 7/00

[52] U.S. Cl. ..... 15/321; 15/339; 417/205

[58] Field of Search ..... 15/320, 321; 417/200, 417/201, 205

[56] References Cited

U.S. PATENT DOCUMENTS

| | | | |
|---|---|---|---|
| Re. 26,950 | 9/1970 | Hays | 15/321 |
| 2,293,722 | 8/1942 | Erickson | 15/320 |
| 2,333,829 | 11/1943 | Terry | 15/320 |
| 2,334,914 | 11/1943 | Erickson | 15/320 X |
| 2,575,675 | 11/1951 | Morgan | 15/320 |
| 2,857,851 | 10/1958 | Fleharty | 417/201 |
| 3,072,950 | 1/1963 | Duff et al. | 15/320 |
| 3,343,199 | 9/1967 | Nolte | 15/321 X |
| 3,896,521 | 7/1975 | Parise | 15/321 |
| 3,939,515 | 2/1976 | Platek | 15/321 |
| 4,123,818 | 11/1978 | Hurwitz | 15/321 |
| 4,138,760 | 2/1979 | Cadle | 15/321 |
| 4,185,354 | 1/1980 | Brazier | 15/321 |
| 4,210,978 | 7/1980 | Johnson et al. . | |
| 4,216,563 | 8/1980 | Cyphert | 15/321 |
| 4,218,805 | 8/1980 | Brazier | 15/321 |
| 4,287,636 | 9/1981 | Brazier | 15/321 |
| 4,314,385 | 2/1982 | Wimsatt et al. | 15/321 |
| 4,329,756 | 5/1982 | Chicoine et al. | 15/321 |
| 4,353,145 | 10/1982 | Woodford | 15/321 |
| 4,829,624 | 5/1989 | Lackner et al. . | |
| 4,864,680 | 9/1989 | Blase et al. | 15/321 |

FOREIGN PATENT DOCUMENTS

| | | |
|---|---|---|
| 382430 | 10/1932 | United Kingdom . |
| 1366248 | 9/1974 | United Kingdom . |
| 1406074 | 9/1975 | United Kingdom . |
| 2038168 | 7/1980 | United Kingdom . |
| 1601456 | 10/1981 | United Kingdom . |
| 1602918 | 11/1981 | United Kingdom . |
| 1602919 | 11/1981 | United Kingdom . |
| 2120568 | 12/1983 | United Kingdom . |
| 2207467 | 2/1989 | United Kingdom . |

*Primary Examiner*—Chris K. Moore

*Attorney, Agent, or Firm*—Price, Heneveld, Cooper, DeWitt & Litton

[57] ABSTRACT

An extractor having a cleaning solution line which extends from the solution tank to a non-self-priming pump and to the normally closed valve which controls the flow of liquid on to the cleaning head. The extractor uses a manually operated priming pump to draw cleaning solution from the solution tank through the cleaning solution line to the non-self-priming pump. Following activation of the manually operated priming pump, a check valve directs the cleaning solution to the operating non-self-priming pump to effect priming of said pump. Solution is then controlably pumped past the fluid flow control valve to the cleaning head. The check valve remains open while the pump is in operation.

16 Claims, 1 Drawing Sheet

EXTRACTOR WITH MANUAL PRIMING PUMP

BACKGROUND OF THE INVENTION

The present invention relates to surface cleaning extractors. Such extractors are devices which apply a cleaning solution to a surface, such as carpet, upholstery and the like, and then vacuum the solution from the surface, extracting dirt and debris from the surface. Such extractors sometimes use built-in solution tanks (including "add on" tanks added to wet vacuums) and sometimes include attachment means with a long hose so the unit can obtain water from a faucet.

When a built-in solution tank is used, a pump is provided for pumping the solution from the tank to a cleaning tool. Often times such pumps are expensive, self-priming units. Alternatively, such pumps can be non-self-priming and positioned such that gravity feeds the solution from the tank to the pump for priming purposes While non-self-priming pumps are attractive from a cost perspective, their dependence upon gravity to move the solution from the tank makes them less attractive. The self-priming units are, of course, attractive, but their expense makes them unattractive for inclusion on a lower cost extractor. Therefore, there is a need to solve this problem of more easily priming an inexpensive non-self-priming pump.

SUMMARY OF THE INVENTION

In the extractor of the present invention, a manually operated priming pump is operatively connected to the cleaning solution line which extends from a cleaning solution tank to the non-self-priming pump and to the normally closed valve which controls the flow of liquid to the cleaning head. Operation of the manually operated priming pump brings cleaning solution through the cleaning solution line to the non-self-priming pump, thereby priming the same.

DETAILED DESCRIPTION OF THE PREFERRED EMBODIMENT

Figure 1:
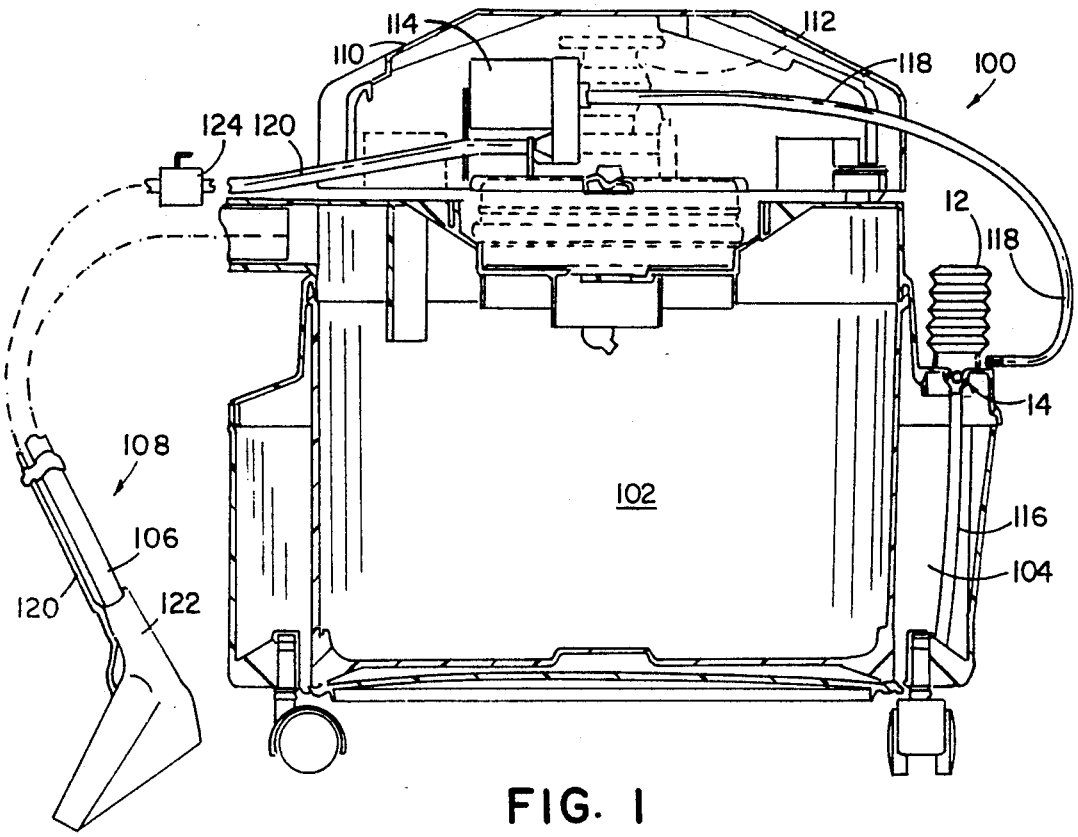
FIG. 1 is a sectional view of the extractor and manual priming pump of the present invention along with a schematic fluid flow control valve and a portion of a wand handle and cleaning head.

In the preferred embodiment, the manually operated priming pump comprises bellows 12 and check valve 14 having a valve body 16 and a valve ball 18. Bellows 12 is operatively connected to solution feed lines 116 and 118 of extractor 100 (FIG. 1). Extractor 100 includes a recovery tank 102, a cleaning solution tank 104, a suction hose 106 extending to cleaning tool 108, and a housing 110. A conventional vacuum fan 112 is located within the housing 110 as is a non-self-priming pump 114.

Figure 2:
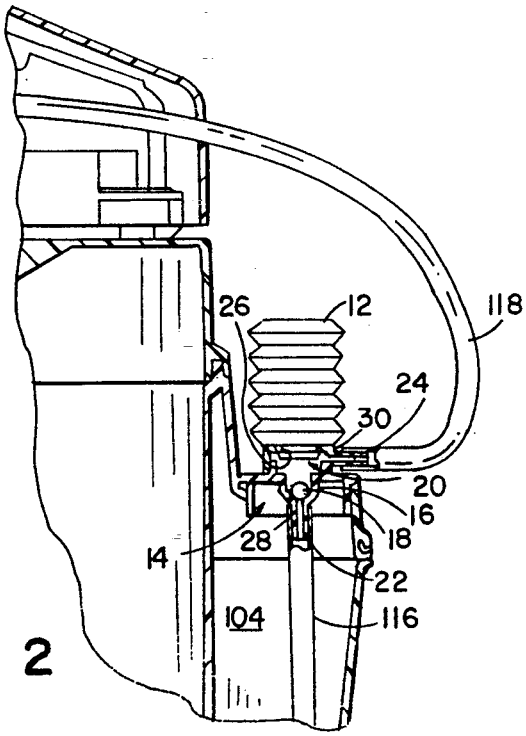
FIG. 2 is an enlarged sectional detail of the manual priming pump of the present invention.

First solution feed line 116 connects cleaning solution tank 104 with a solution entry conduit 22 of check valve 14, FIG. 2. Second solution feed line 118 extends from check valve 14 through a solution exit conduit 24 to pump 114. A third solution feed line 120 connects the pump 114 with the normally closed fluid control valve 124 which controls the flow of fluid to the cleaning head 122 of tool 108.

An aperture 26 is located between check valve 14 and bellows 12 while an aperture 28 is located between check valve 14 and entry conduit 22. An aperture 30 is located between check valve 14 and exit conduit 24. Valve ball 18 is located within valve chamber 20 of check valve 14 and regulates fluid flow between bellows 12, solution tank 104 and solution lines 116 and 118.

Bellows 12 is specifically made of a resilient material capable of substantially rebounding to its original shape after the pressure of compression is removed from it. An elastomeric rubber-like material can be used to make bellows 12. It is also within the scope of the invention to replace bellows 12 with a rubber bulb. The bellows accordion configuration enhances the ability of bellows 12 to spring back to its original configuration.

In static position, valve ball 18 is sized to be seated into sealing engagement with solution entry conduit aperture 28 thus closing off the aperture (FIGS. 1 and 2). In operation, manual compression of bellows 12 (the compression cycle) evacuates bellows 12 through bellows aperture 26 into check valve 14. Valve ball 18 prevents the evacuated air from entering solution line 116, which forces the air to flow out of chamber 20 through solution exit conduit 24 and into solution line 118. Release of bellows 12 (the expansion cycle) creates a vacuum within said bellows which creates a pressure drop in valve chamber 20. This pressure drop pulls valve ball 18 from engagement with aperture 28 and moves the ball either to a neutral position within chamber 20 or into bellows 12. This allows the vacuum to draw liquid from solution tank 104 through solution feed line 116, through aperture 28, into valve chamber 20 and into bellows 12. It is necessary that ball 18 be of such weight and density that following rebound, but prior to recompression of bellows 12, ball 18 will overcome the density of the liquid to again be seated into sealing engagement with solution entry conduit aperture 28, thus closing off the aperture.

Recompression of bellows 12 causes the liquid contained therein to be forced through feed line 118 to pump 114. The position of ball 18 closing aperture 28 prevents the flow of the liquid back into the solution tank 104. Continued compression and rebound of bellows 12 draws liquid from solution tank 104 through the feed line 116 into chamber 20 of bellows 12 and then forces the liquid to flow through line 118 to pump 114. Priming of the pump 114 is then effected while the pump is operating. Following priming of pump 114, the pump 114 causes the solution to flow through solution feed line 120 to cleaning head 122.

Fluid control valve 124 enables the operator of the extractor to control the flow of cleaning solution to the surface being cleaned. The valve 124 is normally closed which enables the manually operated priming pump to draw cleaning solution upward into operating liquid pump 114. If the extractor is turned off, the valve 124 prevents the cleaning solution from siphoning out of the liquid pump 114 maintaining the pump prime.

With pump 114 primed and pumping, the flow of the liquid overcomes the natural tendency of ball 18 to seat in aperture 28 and allows liquid to continuously be removed from solution tank 104. The relative dimensions of ball 18 and chamber 20 are such that ball 18 is small enough to allow passage of liquid around it while located in the neutral position in chamber 20, but also large enough to block aperture 28 when seated. Ball 18 is also small enough to enter bellows 18 through aperture 26. When pump 114 is shut off, ball 18 settles into sealing engagement again with aperture 28.

The above description is considered that of the preferred embodiments only. Modifications of the invention will occur to those who make or use the invention. Therefore, it is understood that the embodiment shown in the drawings and described above is merely for illustrative purposes and is not intended to limit the scope of the invention, which is defined by the following claims as interpreted according to the principles of patent law.

The embodiments of the invention in which an exclusive property or privilege is claimed are defined as follows.

1. An extractor comprising:

a floor supported assembly of a cleaning solution tank, a recovery tank, a housing over said recovery tank, a vacuum fan mounted to said housing and operatively connected with said recovery tank, a non-self-priming pump in fluid communication with said cleaning solution tank and mounted to said housing;

a separate cleaning tool connected in fluid communication with said recovery tank;

a cleaning solution feed line interconnecting said non-self-priming pump and said cleaning tool;

a manually operated priming pump operatively connected with said non-self-priming pump to prime said non-self-priming pump; and a check valve operatively connected in said cleaning solution feed line, in fluid communication with said manually operated priming pump, said check valve being operatively connected between said manually operated priming pump and said cleaning solution tank.

2. An extractor in accordance with claim 1 wherein said manually operated priming pump has an expansible chamber in fluid communication with each of said cleaning solution tank and said non-self-priming pump.

3. An extractor in accordance with claim 2 wherein said expansible chamber is formed of a resilient material capable of rebounding to its original state following compression.

4. An extractor in accordance with claim 3 wherein said manually operated priming pump is of an accordion configuration.

5. An extractor comprising:

a floor supported assembly of a cleaning solution tank, a recovery tank, a housing over said recovery tank, a vacuum fan mounted to said housing and operatively connected with said recovery tank, a non-self-priming pump in fluid communication with said cleaning solution tank and mounted to said housing;

a separate cleaning tool connected in fluid communication with said recovery tank;

a cleaning solution feed line interconnecting said non-self-priming pump and said cleaning tool;

a manually operated priming pump operatively connected with said non-self-priming pump to prime said non-self-priming pump, said manually operated priming pump being connected with said housing.

6. An extractor comprising:

a floor supported assembly of a cleaning solution tank, a recovery tank, a housing over said recovery tank, a vacuum fan mounted to said housing and operatively connected with said recovery tank, a non-self-priming pump in fluid communication with said cleaning solution tank and mounted to said housing;

a separate cleaning tool connected in fluid communication with said recovery tank;

a cleaning solution feed line interconnecting said non-self-priming pump and said cleaning tool;

a manually operated priming pump operatively connected with said non-self-priming pump to prime said non-self-priming pump, said manually operated priming pump being mounted on said cleaning solution tank.

7. An extractor comprising:

a recovery tank;

a housing over said recovery tank;

a vacuum fan mounted to said housing and operatively connected with said recovery tank;

a cleaning tool, separate from said housing and connected in fluid communication with said recovery tank;

a cleaning solution tank assembled with said recovery tank;

a cleaning solution feed line interconnecting said cleaning solution tank and said cleaning tool to deliver a cleaning solution from said cleaning solution tank to said cleaning tool;

a pump mounted to said housing and operatively connected in said cleaning solution feed line to pump cleaning solution from said cleaning solution tank to said cleaning tool; and a priming device operatively connected with said pump to prime said pump.

8. An extractor in accordance with claim 7 wherein said priming device is a manually operated priming pump with an expansible chamber in fluid communication with each of said cleaning solution tank and said non-self-priming pump.

9. An extractor in accordance with claim 8 wherein said manually operated priming pump is a rubber bulb.

10. An extractor in accordance with claim 8 wherein said manually operated priming pump is a bellows.

11. The extractor defined in claim 7 further including a check valve operatively connected in said cleaning solution feedline to allow delivery of cleaning solution from said cleaning solution tank to said cleaning tool and to block return of cleaning solution to said cleaning solution tank.

12. The extractor defined in claim 11 wherein said check valve is positioned between said priming device and said cleaning solution tank.

13. The extractor defined in claim 12 wherein said priming device has an expansible chamber in fluid communication with each of said cleaning solution tank and said non-self-priming pump.

14. The extractor defined in claim 13 wherein said priming device is mounted on said cleaning solution tank.

15. The extractor defined in claim 14 wherein said recovery tank has a perimeter side wall and said cleaning solution tank abuts said side wall and at least partially circumscribes said recovery tank.

16. The extractor defined in claim 7 wherein said recovery tank has a perimeter side wall and said cleaning solution tank abuts said side wall and at least partially circumscribes said recovery tank.

* * * * *

UNITED STATES PATENT AND TRADEMARK OFFICE

CERTIFICATE OF CORRECTION

PATENT NO. : 5,289,611

DATED : March 1, 1994

INVENTOR(S) : Yonkers, et al

It is certified that error appears in the above-indentified patent and that said Letters Patent is hereby corrected as shown below:

Column 1, line 19;

After "purposes" insert – . –.

Column 3, line 57, claim 5;

After "tool;" insert –and–.

Column 4, line 7, claim 6;

After "tool;" insert –and–.

Signed and Sealed this

Eighteenth Day of October, 1994

Bruce Lehman

*Attest:*

BRUCE LEHMAN

*Attesting Officer*

*Commissioner of Patents and Trademarks*